US010371435B2

(12) United States Patent
Kang

(10) Patent No.: US 10,371,435 B2
(45) Date of Patent: Aug. 6, 2019

(54) REFRIGERATOR

(71) Applicant: LG Electronics Inc., Seoul (KR)

(72) Inventor: Daekil Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 30 days.

(21) Appl. No.: 15/348,795

(22) Filed: Nov. 10, 2016

(65) Prior Publication Data

US 2017/0176087 A1 Jun. 22, 2017

(30) Foreign Application Priority Data

Dec. 17, 2015 (KR) ..... 10-2015-0181315

(51) Int. Cl.
*F25D 23/02* (2006.01)
*F25D 11/02* (2006.01)

(52) U.S. Cl.
CPC ..... *F25D 23/025* (2013.01); *F25D 11/02* (2013.01); *F25D 23/028* (2013.01); *F25D 2323/023* (2013.01); *F25D 2323/024* (2013.01)

(58) Field of Classification Search
CPC ..... F25D 23/025; F25D 23/028; F25D 2323/023; F25D 2323/024; F25D 11/02; E05B 65/0042; E05Y 2900/31; E05Y 2800/71; E05C 7/02; E05D 7/00; E05D 7/81; E05D 7/081; E05D 7/06; E05D 7/04; E05D 7/045; E05F 5/00
USPC ..... 312/405, 291, 292
See application file for complete search history.

(56) References Cited

U.S. PATENT DOCUMENTS 172,106 A * 1/1876 Feige
369,458 A * 9/1887 Link
2,150,064 A * 3/1939 John ..... F25D 23/04 292/169
2,204,053 A * 6/1940 Dart ..... E05B 65/0042 292/5

(Continued)

FOREIGN PATENT DOCUMENTS

CN 102695933 9/2012
CN 104864658 8/2015

(Continued)

OTHER PUBLICATIONS

Extended European Search Report in European Application No. 16200476.6, dated Mar. 30, 2017, 8 pages (with English translation).

(Continued)

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet including a storage compartment provided therein; a first door rotatably coupled to the cabinet to open and close the storage compartment; a second door rotatably coupled to the first door and comprising a stopper; a locking device configured to selectively allow the rotation of the second door with respect to the first door, wherein the locking device includes a moving member having different displacements according to an opening/closing state of the first door; and a hooking member having different displacements according to the displacements of the moving member and selectively hooking the stopper thereto.

20 Claims, 7 Drawing Sheets

(56) References Cited

U.S. PATENT DOCUMENTS

| | | | | |
|---|---|---|---|---|
| 2,942,438 | A * | 6/1960 | Schmeling | F25D 23/04 62/377 |
| 3,086,830 | A * | 4/1963 | Malia | F25D 23/04 292/31 |
| 7,267,379 | B2 * | 9/2007 | Rusiana | E05B 15/101 292/137 |
| 8,654,534 | B2 * | 2/2014 | Zhang | H05K 7/1489 312/221 |
| 8,801,124 | B2 * | 8/2014 | Jung | F25D 23/04 312/291 |
| 9,170,045 | B2 * | 10/2015 | Oh | F25D 23/02 |
| 9,441,872 | B2 * | 9/2016 | Park | F25D 11/02 |
| 9,482,463 | B2 * | 11/2016 | Choi | F25D 23/04 |
| 9,605,891 | B2 * | 3/2017 | Lee | F25D 23/02 |
| 2013/0049562 | A1 * | 2/2013 | Jung | F25D 23/028 312/405 |
| 2014/0217750 | A1 * | 8/2014 | Lin | E05C 7/045 292/156 |
| 2014/0232250 | A1 * | 8/2014 | Kim | F25D 23/028 312/292 |
| 2015/0069900 | A1 * | 3/2015 | Lim | F25D 23/028 312/405 |
| 2015/0137674 | A1 * | 5/2015 | Choi | F25D 23/04 312/404 |
| 2015/0368944 | A1 * | 12/2015 | Yi | B21D 53/40 312/405 |
| 2017/0191746 | A1 * | 7/2017 | Seo | F25D 27/005 |
| 2017/0356685 | A1 * | 12/2017 | Jung | E05D 7/00 |

FOREIGN PATENT DOCUMENTS

| | | |
|---|---|---|
| EP | 2565565 | 3/2013 |
| EP | 2910879 | 8/2015 |
| JP | S63-142682 | 6/1988 |
| JP | 2003302150 | 10/2003 |

OTHER PUBLICATIONS

Chinese Office Action in Chinese Appln. No. 201611145057.6, dated Dec. 12, 2018, 15 pages (with English translation).

* cited by examiner

REFRIGERATOR

CROSS-REFERENCE TO RELATED APPLICATIONS

Pursuant to 35 U.S.C. § 119(a), this application claims the benefit of an earlier filing date and right of priority to Korean Application No. 10-2015-0181315, filed on Dec. 17, 2015, the contents of which are hereby incorporated by reference herein in their entirety.

TECHNICAL FIELD

The present disclosure relates to a refrigerator more particularly, to a refrigerator including a double door system.

BACKGROUND

A refrigerator is an electric appliance configured to freeze or refrigerator the food stuffs stored in one or more storage compartments by lowering the temperature in the storage compartments, using the cold air generated via the freezing cycle configured of a compressor, a condenser, an expansion valve and an evaporator.

Such a refrigerator typically includes a refrigerator compartment for storing refrigerated food or beverage at a low temperature and a freezer compartment for storing frozen food at a low temperature below zero.

The refrigerator may be categorized into a top mount type refrigerator having a freezer compartment arranged in a top; a bottom freezer type refrigerator having the freezer compartment arranged in a bottom; and side-by-side type refrigerator having the freezer and refrigerator compartments arranged side by side. In this instance, doors are coupled to the freezer and refrigerator compartments, respectively, so that a user can have access to the compartments.

Rather than the refrigerator having the freezer and refrigerator compartments provided independently, there is another type of a refrigerator having one door. Such the refrigerator allows the user to have an access to the freezer or refrigerator compartment via one door and it is usually a mini refrigerator having the freezer compartment provided in a predetermined internal space of the refrigerator compartment.

The top mount type refrigerator includes a French type refrigerator having the top mount refrigerator compartment which is closable by right and left doors. The freezer compartment of the French type refrigerator can be also open and closed by right and left doors.

Recently, the refrigerator is provided with diverse functions which developed from original functions of freezing or refrigerating food or beverages. Specifically, a dispenser is installed in the door of the refrigerator to provide purified water and ice. A display is provided in a front surface of the door to show an operational state of the refrigerator so that the user can manage the refrigerator.

There is released a type of a refrigerator having the storage compartment configured to be partially open. In other words, a sub-door is provided in a sub-storage compartment which is provided in a main-door of the refrigerator. A predetermined area of the main-storage compartment as the sub-storage compartment is partitioned off by a partition wall. Such the type of the refrigerator may be called a DID (door in door) refrigerator or a double-door refrigerator. When the sub-door is open, the cold air leaked outside from the main-storage compartment may be reduced enough to enhance energy efficiency.

For example, the beverages which are used often are stored in the sub-storage compartment and the user can open the sub-door to have access to the sub-storage compartment, without opening the main-door.

SUMMARY

In one aspect a refrigerator may include: a cabinet including a storage compartment provided therein; a first door rotatably coupled to the cabinet to open and close the storage compartment; a second door rotatably coupled to the first door and comprising a stopper; a locking device configured to selectively allow the rotation of the second door with respect to the first door, wherein the locking device includes a moving member having different displacements according to an opening/closing state of the first door; and a hooking member having different displacements according to the displacements of the moving member and selectively hooking the stopper thereto.

The moving member may be configured to be moved upward according to an opening/closing state of the first door. In a state where the moving member is moved upward, the hooking member may not lock the stopper. In a state where the moving member is moved downward, the hooking member may lock the stopper. Unless the hooking member locks the stopper, the stopper is able to become freely moved and the second door is able to be freely rotated with respect to the first door.

The second door may be rotatable with respect to the first door. The stopper may be also rotatable together with the second door. When the rotation of the stopper is allowed, the second door is also rotated with respect to the first door. In contrast, when the rotation of the stopper is locked, the rotation of the second door is also locked with respect to the first door.

The stopper may be integrally rotatable with the second door, and the hooking member may be provided in the first door and the stopper is hooked to the hooking member to lock the rotation of the second door with respect to the first door.

The refrigerator may further comprise a hinge configured to rotate the second door with respect to the first door, wherein the stopper is provided in the hinge.

The hinge may comprise a hinge shaft forming a rotation axis of the second door; a hinge bracket coupled to the second door; and the stopper, and the hinge shaft, the hinge bracket and the stopper may be integrally formed with each other.

The stopper may be provided in a predetermined portion having a preset radius from the hinge shaft, and the stopper may be rotated together with the second door, when the second door is rotated.

A hinge accommodating portion may be provided in the first door and accommodates the hinge shaft and the stopper, and the stopper is rotatable within the hinge accommodating portion. In other words, when the second door is rotated on the hinge shaft, the stopper may be rotated on the hinge shaft within the hinge accommodating portion. Accordingly, the stopper may be located in the first door and the user cannot see the stopper outside the first door.

The moving member may be located in a first position in a state where the first door is closed and in a second position when the first door is open. In other words, the moving member is movable between the first position and the second position, in relation to the opening/closing state of the first door.

The moving member may be provided to selectively contact with a reference member provided in the cabinet. The moving member may make contact with the reference member, that is, be located in the first position, in a state where the first door is closed. The moving member may be configured to release the contact with the reference member, that is, be located in the second position, when the first door is open.

The moving member may be integrally rotated with the first door and the reference member is fixed to the cabinet. Accordingly, the moving member has a relative displacement with respect to the reference member according to the rotation of the first door.

The refrigerator may further comprise a main-hinge configured to rotate the first door with respect to the cabinet, wherein the locking device is provided in the first door and integrally rotated with the first door.

The main-hinge may comprise a main-hinge bracket coupling the main-hinge to the cabinet; and a horizontal bracket supporting vertical load of the main-door.

The moving member may make contact with the horizontal bracket and be located in the first position, in a state where the first door is closed, and the moving member may release the contact with the horizontal bracket and is moved downward to be located in the second position, when the first door is open. Accordingly, the horizontal bracket may be the reference member.

The moving member may have a preset radius from the rotation axis of the first door, and be integrally rotated with the first door with respect to the rotation axis, when the first door is rotated.

The moving member may be extended toward the horizontal bracket provided outside the first door from an internal space of the first door. Accordingly, the moving member is moved upward over the horizontal bracket and contacts with an upper portion of the horizontal bracket. At this time, the moving member is located in the first position. The moving member is moved downward along the horizontal bracket and releases the contact with the horizontal bracket. At this time, the moving member is located in the second position.

The moving member may comprise one end having inclined portions formed in both sides to facilitate relative movement of the moving member with respect to the horizontal bracket. The friction force between the moving member and the horizontal bracket may be reduced.

The moving member may comprise a plurality of bending portions to compensate a deviation in up, down, right and left locations between the main-hinge and the hinge.

When the moving member is located in the first position, the hooking member may be located in an unlocking position for unlocking the stopper. When the moving member is located in the second position, the hooking member may be located in a locking position for locking the stopper. The unlocking position of the hooking member may be the first position of the hooking member. The locking position of the hooking member may be the second position of the hooking member.

When the moving member may be moved upward to be located in the first position, the hooking member may be moved downward to be located in the unlocking position. When the moving member is moved downward to be located in the second position, the hooking member may be moved downward to be located in the locking position.

The refrigerator may further comprise a switchover member switching the upward movement of the moving member into the downward movement of the hooking member, and switching the downward movement of the moving member into the upward movement of the hooking member.

The switchover member may comprise a central shaft; a first extended portion extended to one side from the central shaft and moved upward in relation to the upward movement of the moving member; and a second extended portion extended to the other side from the central shaft and moved upward in the reverse direction of the first extended portion, and the hooking member is formed by the second extended portion.

The refrigerator may further comprise a flexible member elastically deformed when the hooking member is moved upward and providing an elastic restoring force when the hooking member is moved downward. The flexible member may be a torsion spring provided in the central shaft.

The switchover member switches the displacement direction of the moving member into the displacement direction of the hooking member. The switchover member may effectively damp the shock applied to the locking device, in a state where both of the first and second doors are open, in other words, in the user's abnormal operation of the door.

Specifically, the switchover member may be pressed by the stopper. When only the second door is closed in a state where both of the first and second doors are open, the stopper may press the switchover member. While moved upward from the first extended portion over the second extended portion, the stopper may press the switchover member. Accordingly, the switchover member may be formed in a seesaw-like shape and the stopper may move over the switchover member.

At this time, the hooking member may be moved from the locking position to the unlocking position. When the second door is closed completely, the hooking member may be moved to the locking position from the unlocking position again. At this time, the movement to the locking position may be performed by the elastic restoring force of the flexible member.

The locking device may comprise a housing accommodating the moving member and guiding the movement of the moving member, and the housing may be embedded in the first door. One end of the moving member may be extended to the outside of the housing and even to the outside of the first door.

The refrigerator may further comprise a door frame provided in the first door and comprising a hinge opening; wherein the second door comprises a lateral wall partially inserted in the door frame, and the hinge is extended to an internal space of the first door from the lateral wall via the hinge opening. Accordingly, the hinge shaft of the hinge and the stopper may be located within the first door via the hinge opening.

The hooking member may be also located in the first door. The connection and disconnection of the stopper and the hooking member may be performed within the first door. Accordingly, the mechanism of the locking device may be performed stably and reliably.

A rotation direction of the first door may be equal to a rotation direction of the second door.

In another aspect, a refrigerator may include: a cabinet including a storage compartment provided therein; a first door rotatably coupled to the cabinet to open and close the storage compartment; a second door rotatably coupled to the first door; a stopper integrally rotatable with the second door in the first door; and a locking device configured to selectively allow the rotation of the second door with respect to the first door, wherein the locking device includes a moving member moved to be located in a first position in a state where the first door is closed and to be located in a second position when the first door is open; and a hooking member located in a locking position and a unlocking position, in relation to the movement of the moving member, and selectively locking the stopper.

The moving member may be configured to move upward. The first position may be higher than the second position. The moving member may be substantially located in the first position and the second position.

The hooking member may be provided in the first door, and when the moving member is located in the first position, the hooking member may be located in the locking position to lock the rotation of the second door by locking the rotation of the stopper.

A reference member may be provided in the cabinet. As the first door is open and closed with respect to the cabinet, the relative position of the moving member with respect to the reference member is varied. As the relative position is varied, the moving member may selectively make contact with the reference member.

In another aspect, a refrigerator may include: a cabinet including a storage compartment provided therein; a first door rotatably coupled to the cabinet via a main-hinge to open and close the storage compartment; a second door rotatably coupled to the first door via a sub-hinge; a stopper provided in the sub-hinge; and a locking device configured to selectively allow the rotation of the second door with respect to the first door, wherein the locking device includes a moving member moved to be located in a first position in a state where the first door is closed and to be located in a second position when the first door is open; and a hooking member located in a locking position and a unlocking position, in relation to the movement of the moving member, and selectively locking the stopper.

The moving member may be movable along the rotation of the second door.

The stopper and the hooking member may be provided in the first door, and configured not to be visibly exposed outside the first door. The moving member may be substantially provided in the first door. The moving member may be located in the first door by locating the reference member in the first door.

The locking member may comprise a switchover member provided between the stopper and the hooking member and switching a moving direction of the moving member into a moving direction of the hooking member.

When only the second door is closed in a state where the second door is open with respect to the first door after the first door is open, the switchover member may be pressed by the stopper and move the hooking member in the locking position to the unlocking position.

The refrigerator may further comprise a flexible member for restituting the hooking member, having moved to the unlocking position from the locking position, to the locking position.

The directions of the elastic force and elastic restoring force are the direction of the hooking member moved upward, that is, the vertically upward and downward direction. The sealing force of the first door may not be affected by the elastic force and elastic restoring force of the flexible member.

Accordingly, the deterioration of the sealing force generated by the first door may be prevented by the flexible member of the locking device.

The refrigerator may be configured to prevent a second door from being separated from a first door by an inertial force. Especially, the refrigerator is configured to prevent the second door from being separated from the first door, when the first door is closed and/or the first door is suddenly stopped after open.

The refrigerator may have a beautiful design by preventing the design damage generated by the locking device. Especially, the locking device and the operation of the locking device provided in the refrigerator are out of the user's sight, so that the refrigerator can have the beautiful design.

The refrigerator may be configured to mechanically recognize the closed or open state of the first door. Accordingly, the refrigerator may have the locking device with a simple structure and reliability.

The refrigerator may not deteriorate the sealing of the door gasket between the first door and the cabinet.

The refrigerator may be configured to prevent minimizing the deterioration of the heat insulation performed by first and second doors because of the locking device. The refrigerator may be configured to prevent the structure of the first and second doors from becoming complex by the locking device.

The refrigerator may minimize the influence of external interference by locating the stopper and the hooking member in the first door, when the stopper and the hooking member are moved for locking and unlocking.

The DID refrigerator having the first door and the second door closed by being inserted in a door frame of the first door, the refrigerator further including a locking device which uses a hinge of the first door and a hinge of the second door.

In another aspect, a refrigerator may be configured to dampen the shock applied to a locking device and convert a current state into a locking state for locking the rotation of a second door smoothly, when only the second door is closed after the first and second doors are open.

In another aspect, a refrigerator may be configured to transmit an open/closed state of a first door to a locking device immediately.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

DETAILED DESCRIPTION

Description will now be given in detail according to exemplary embodiments disclosed herein, with reference to the accompanying drawings.

In some implementations, a refrigerator may help prevent a second door from being separated from a first door by an inertial force. For example, the refrigerator may be configured to prevent the second door from being separated from the first door, when the first door is closed and/or the first door is suddenly stopped after open.

Exemplary embodiments of the present disclosure also provide a refrigerator having a beautiful design by preventing the design damage generated by a locking device. Especially, the locking device and the operation of the locking device provided in the refrigerator are out of the user's sight, so that the refrigerator can have the beautiful design.

Exemplary embodiments of the present disclosure also provide a refrigerator capable of mechanically recognizing a closed or open state of a first door. Accordingly, the refrigerator may have a locking device with a simple structure and reliability.

Exemplary embodiments of the present disclosure also provide a refrigerator which may not deteriorate the sealing of a door gasket between a first door and a cabinet.

Exemplary embodiments of the present disclosure also provide a refrigerator which is capable of preventing minimizing the deterioration of the heat insulation performed by first and second doors because of a locking device. The refrigerator is capable of preventing the structure of the first and second doors from becoming complex by the locking device.

Exemplary embodiments of the present disclosure also provide a refrigerator which minimizes the influence of external interference by locating a stopper and a hooking member in a first door, when a stopper and a hooking member are moved for locking and unlocking.

Exemplary embodiments of the present disclosure also provide a DID refrigerator having a first door and a second door closed by being inserted in a door frame of the first door, the refrigerator further including a locking device which uses a hinge of the first door and a hinge of the second door.

Exemplary embodiments of the present disclosure also provide a refrigerator which is capable of damping the shock applied to a locking device and converting a current state into a locking state for locking the rotation of a second door smoothly, when only the second door is closed after the first and second doors are open.

Exemplary embodiments of the present disclosure also provide a refrigerator which is capable of transmitting an open/closed state of a first door to a locking device immediately.

Figure 1:
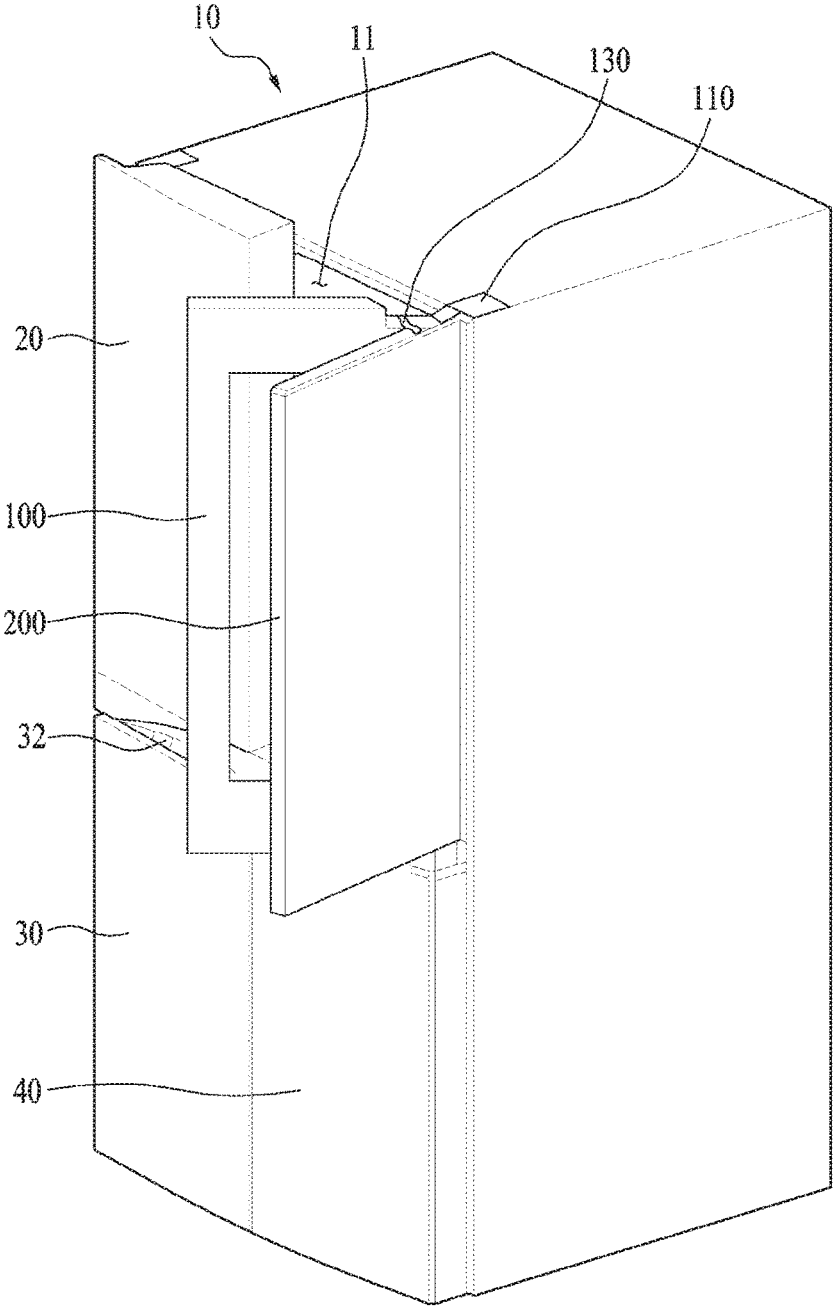
FIG. 1 is a diagram illustrating one example of a conventional double-door refrigerator or a DID refrigerator.

FIG. 1 is a diagram illustrating one example of a conventional DID refrigerator or double-door refrigerator.

The refrigerator illustrated in FIG. 1 is a bottom freezer type refrigerator including a refrigerator compartment arranged in a top of a cabinet 10 and a refrigerator compartment arranged in a bottom of the cabinet 10. It can be said that the refrigerator and freezer compartments are parts of the storage compartment or main-compartment 11 provided in the cabinet 10.

In the illustrated embodiment, a left refrigerator door 20 and a right refrigerator door 25 are rotatably coupled to left and right sides of the cabinet 10 as a door for opening and closing the refrigerator compartment.

As a door for opening and closing the freezer compartment, a left freezer door 30 and a right freezer door 40 are rotatably coupled to both sides of a lower front surface of the cabinet 10. As one alternative example, as the freezer door, one door is rotatably provided or a drawer type door is retractably provided.

A handle recess 32 may be provided in an upper surface of the left refrigerator door 30 and a handle recess may be also provided in an upper surface of the right refrigerator door 40.

As shown in FIG. 1, the right refrigerator door 25 may include a main-door 100 rotatably coupled to a side of the cabinet 10 by a main-door hinge 110; and a sub-door 200 rotatably coupled to the main-door 100 or the cabinet 10 by a sub-door hinge 130. In other words, when opening the main-door 100 and the sub-door 200, the user may approach the refrigerator.

An opening is provided in a central portion of the main-door 100 and a sub-storage (not shown) may be provided in a rear surface of the main-door 100.

When opening the sub-door 200, the user may approach the sub-storage compartment through the opening of the main-door 100. In other words, the user is able to approach the sub-storage compartment by opening only the sub-door 200, without opening the main-door 100.

As shown in the drawing, the conventional DID refrigerator or double-door refrigerator has the structure having the sub-door 200 overlapped with the main-door 100. In other words, it can be said that the sub-door 200 covers the front surface of the main-door 100. The front surface area of the main-door 100 is substantially equal to the front surface area of the sub-door 200.

As using form, the user opens the main-door 100 and the sub-door 200 together to use the main-storage compartment 11 and the user opens only the sub-door 200 to use the sub-storage compartment.

When the main-door 100 is closed in a state where the main-door 100 and the sub-door 200 are open together, it might happen that the main-door 100 and the sub-door 200 are separated from each other by the inertial force.

As shown in FIG. 1, the sub-door 200 might be separated from the main-door 100, if the user strongly closes the main-door 100 in in a state where the main-door and the sub-door 200 are open together.

When the user suddenly stops the rotation of the main-door 100 after opening the main-door 100, only the sub-door 200 separated from the main-door 100 might become rotated more by the inertial force.

The user usually moves the body to get out the lotus of door opening. When closing the door 100, the user usually moved toward the cabinet. Even though the user moves the body toward the cabinet, with thinking that he or she closed the door, the door fails to be closed and the user's body happens to run into the door. That is because the user considers only the rotation of the main-door 100 unconsciously in case of operating the main-door 100, not the relative rotation of the sub-door 200.

Especially, as shown in FIG. 1, the accident of the sub-door 200 running into the user could occur more often, when the sub-door 200 is open with only the main-door 100 being closed or the main-door 100 is open with only the sub-door 200 being closed, in case the rotation locus and rotation radius of the main-door 100 are substantially equal to those of the sub-door 200.

To solve such the problem, a locking system may be provided to lock the sub-door 200 from getting separated from the main-door 100 when the main-door 100 is open and to unlock the sub-door 200 from the main-door 100 to become open only when the main-door is closed.

However, it is not easy to provide such a locking system to the door of the refrigerator, considering characteristics of the door, because the door is provided in the front surface of the refrigerator and represents an overall exterior design of the refrigerator. It is not quite preferred that the locking system is exposed outside the refrigerator and the exposure of the locking system needs an auxiliary space. Accordingly, it is concerned that the locking system will not be properly operated because of external shocks or objects.

In addition, the locking system may not be the means for manipulate locking and unlocking as a safety part. In other words, it is preferred that the locking system performs its function without getting noticed by the user. It is necessary to provide a new locking system not exposed to the outside of the refrigerator, especially, the outside of the main-door 100 or the sub-door 200.

Meanwhile, the door of the refrigerator has to serve as an insulation wall for blocking cold air and it needs to be prevented that the function of the insulation wall is deteriorated by the locking system.

Accordingly, there are increasing demands for a DID refrigerator or a double-door refrigerator configured to satisfy a reliable connected relation to the external design element of the refrigerator, the heat insulation wall of the door, the reliability of the locking system and the door of the refrigerator.

Figure 2:
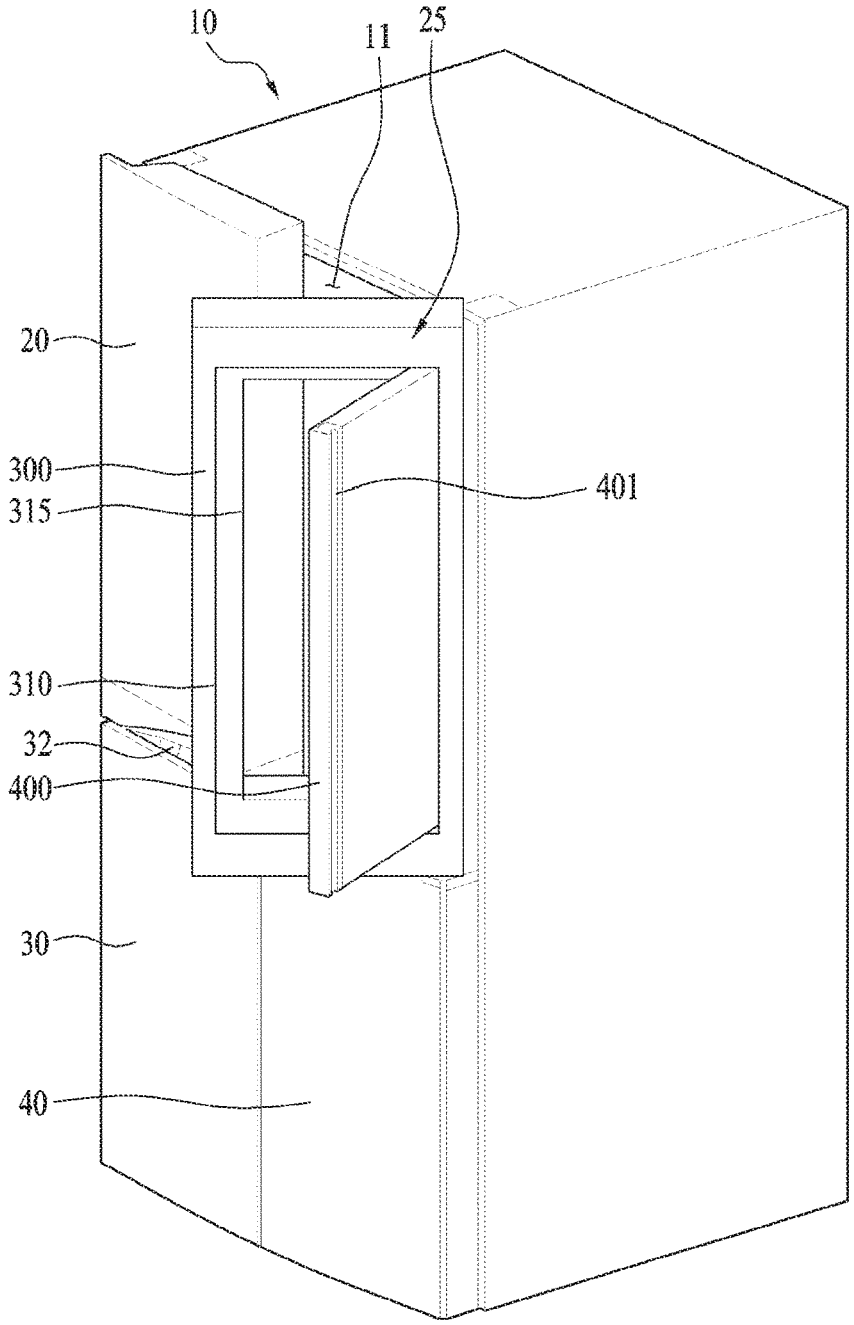
FIG. 2 is a diagram illustrating one example of a refrigerator in accordance with the present disclosure.

FIG. 2 is a diagram illustrating one example of a refrigerator in accordance with the present disclosure. Technical features of the present disclosure may be applicable to a side by side refrigerator or a refrigerator having one door as well as the illustrated refrigerator, only if those refrigerators have a main-door (a first door) and a sub-door (a second door) rotatable with respect to the main-door. Moreover, the technical features of the present disclosure may be applicable even to an outside type DID refrigerator shown in FIG. 1. In other words, they may be applicable to a refrigerator including a main-door and a sub-door rotatably coupled to the main-door.

As shown in the drawing, the example of the refrigerator include a right refrigerator door 25 rotatably coupled to the cabinet 10. The right refrigerator door 25 may include a main-door 300 (hereinafter, a first door) rotatably coupled to the cabinet 10 and having an opening 310 provided in an inner central portion; and a sub-door 400 (hereinafter, a second door) inserted in the opening 310 of the first door 300 and rotatable with respect to the main-door.

In the refrigerator illustrated in the drawing, the second door 400 is smaller than the first door 300 and inserted in the opening 310 of the first door, when it is closed. In other words, a predetermined portion of the second door 400 with respect to the back-and-force width may be inserted in the first door. It can be said that a predetermined portion of a lateral surface of the second door 400 is inserted in the opening 310 of the first door.

The illustrated example of the present disclosure may be the refrigerator of which the second door 400 is inserted in the first door 300 in a state where the first door 300 is closed and such the refrigerator may be called an inside type DID refrigerator or an inside type double-door refrigerator.

Figure 3:
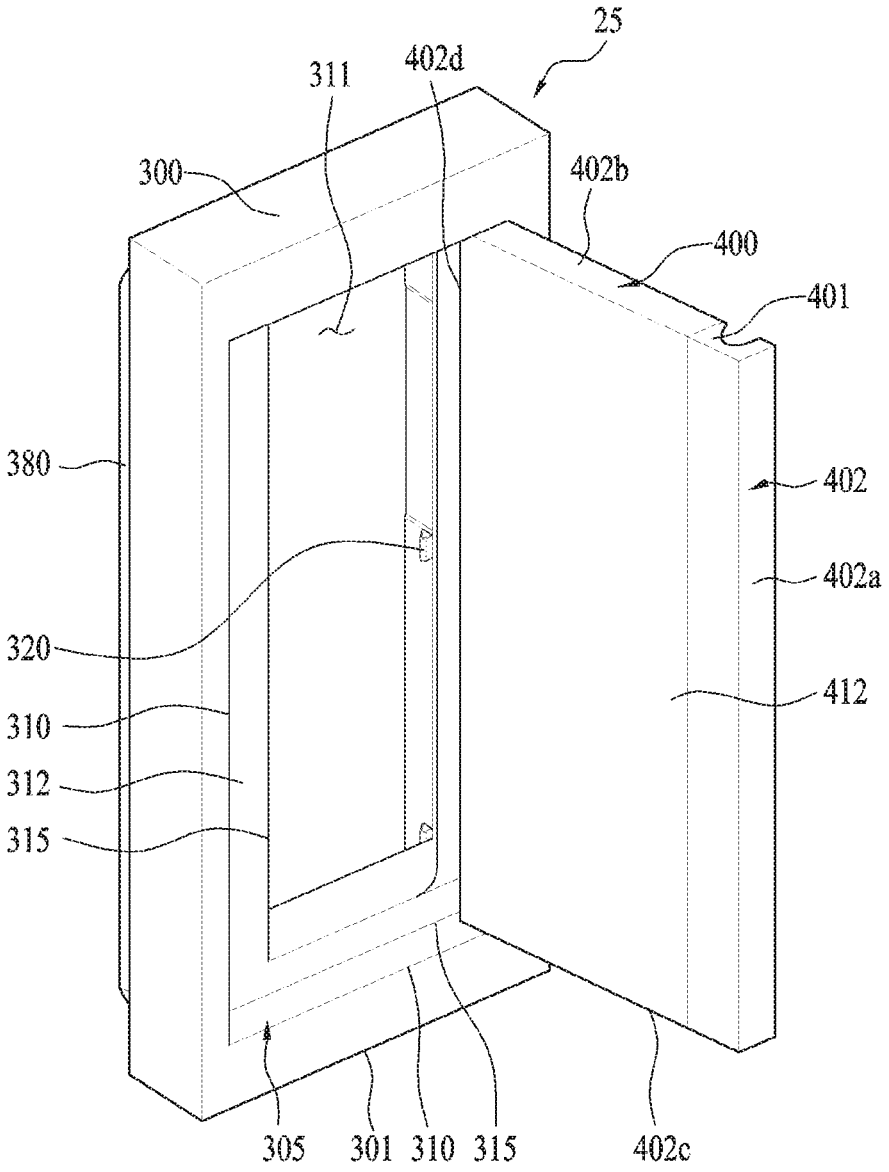
FIG. 3 is a diagram illustrating a first door and a second door which are shown in FIG. 2.

FIG. 3 is a diagram illustrating only the door shown in FIG. 2.

Another opening 315 is provided in an inner central portion of the first door 300 and a sub-storage compartment 311 may be provided in a rear surface of the first door 300. In short, the first door 300 includes the opening 310 for inserting the sub-door 400 and the opening 315 for approaching the sub-storage compartment 311. The latter opening 315 may be formed in an inner radial rim of the former opening 310.

A gasket 380 of the first door 300 may be provided along an edge portion of a rear surface of the first door. Cold air is sealed between the first door 300 and an internal space of the cabinet by the gasket 380.

A flat portion may be formed for sealing between the two openings 310 and 315 and called a gasket sealing portion 312. The gasket sealing portion 312 is corresponding to a gasket sealing 412 formed in the first door 300.

The two gasket sealing portions 412 and 312 are corresponding to each other and they facilitate the sealing between the first door 300 and the second door 400. The sub-storage compartment 311 may be substantially located in an inner radial portion of the gasket sealing portions 412 and 312.

When opening the second door 400, the user may have access to the sub-storage compartment 311 via the opening 315 of the first door 300. In other words, the user can have access to the sub-storage compartment 311 only when opening the second door 400, without opening the first door 300.

A plurality of baskets may be mounted vertically to form the sub-storage compartment. Specifically, a cover (not shown) for covering the plurality of the baskets (not shown) may be provided and serves as a partition wall for partitioning the sub-storage compartment 311 and the main-storage compartment 11 from each other. Accordingly, the sub-storage compartment may be located in a front portion of the main-storage compartment.

As shown in FIG. 3, mounting projections for mounting the plurality of the baskets may be provided in an inner rear surface of the opening 315 formed in the second door 400. Two or three pairs of the baskets which are not shown in the drawing may be vertically mounted at preset intervals. When opening the second door 400 in a state where the first door 300 is closed, the user has access to the sub-storage compartment 311.

More specifically, a door frame 305 is provided in the first door 300. The first door 300 itself may be the door frame 305. The opening may be formed in the door frame 305. When the second door 400 is mounted in the door frame 305, it can be said that the second door 400 is closed. When the second door 400 is out of the door frame 305, it can be said that the second door is open. FIG. 3 illustrates an open state of the second door 400.

A handle 401 may be provided in the second door 400. The user can open and close the second door 400, holding the handle 401. A handle 301 may be also provided in the first door 300. Specifically, the handle 301 of the first door 300 may be provided in an outer portion of the door frame 305. The first door handle 301 may be formed in an outer lateral surface or an outer bottom surface of the door frame 305. The shapes or forms of the handles 301 and 401 may be variable. However, it is preferred that the handles are independent parts from each other.

More specifically, the first door handle 301 may be configured to open and close the first door and the second door handle 401 may be configured to open and close the second door, so that it can be preferred that the handles 310 and 401 are independently provided.

In a normal opening process, the user opens the first door 300, with holding the first door handle 301. At this time, the user opens the first door 300 against a magnetic force generated between the first door 300 and the cabinet 10. Such a magnetic force is usually generated by a rubber magnet gasket. Similarly, in a normal opening process, the user opens the second door 400, with holding the second door handle 401. At this time, the user opens the second door 400 against a magnetic force generated by the rubber magnet gasket.

The user may open the second door 400 against the magnetic force generated between the first 300 and the second door 400 by the rubber magnet gasket, in the normal state (a state where the first door is closed). In other words, no additional device or force for preventing the separation of the two components has to be provided. This premise may be the reason why the second door 400 is separated from the first door 300 abnormally.

When the user strongly closes the first door 300 in a state where the first and second doors 300 and 400 are open together, the inertial force of the second door 400 is stronger than the magnetic or sealing force between the doors. Accordingly, only the first door 300 is closed after separated from the second door 400 disadvantageously. Similarly, when the user suddenly stops the first door 300 after strongly opening it, the inertial force of the second door 400 is stronger than the magnetic or sealing force between the two doors and only the second door 400 is disadvantageously open more after separated from the first door 300.

The refrigerator in accordance with the present disclosure includes a locking device 500 selectively allowing the second door 400 to rotate with respect to the first door 300. The locking device 500 may be configured to selectively limiting the rotation of the second door 400 with respect to the first door 300.

More specifically, the locking system allows the second door 400 to rotate about the first door 300 when the first door 300 is closed and not to rotate when the first door 300 is open. In other words, the second door 400 is locked to the first door 300 when the first door 300 is open so that it cannot be open. The locking device 500 performs such the function.

When the first door 300 is closed, the user holds the handle 401 and opens the second door 400. At this time, the locked state of the second door 400 enabled by the locking device 500 is released and the user is able to easily open the second door 400 only after getting over the magnetic force generated by the gasket arranged between the first door 300 and the second door 400. The other obstructive factors such as a friction force generated by a hinge and the like may be ignored.

In contrast, even when the first door 300 is open, the user holds the handle 401 and tries to open the second door 400. At this time, the locking device 500 is operated for the locking and the user cannot open the second door 400. Accordingly, the separation of the second door 400 from the first door 300 (the opening of the second door 400 with respect to the first door 300) may be prevented even when the user strongly closes the second door 400, with the first door being closed.

The first and second doors 300 and 400 may be open and closed along the same rotation direction. For example, the first door 300 and the second door 400 shown in FIG. 2 are provided to rotate on a vertical shaft provided in a right portion. The first door 300 is able to be rotatable on a shaft 350 with respect to the cabinet 10 and the second door 400 is able to be rotatable on a shaft (not shown) with respect to the first door 300. The rotational direction relation between the first and second doors 300 and 400 might cause the separation of the second door from the first door 300 by the inertial force when the user closes the first door 300. When the first door 300 strongly open is stopped, the second door 400 is likely to become separated from the first door 300 by the inertial force.

Hereinafter, referring to FIGS. 4 and 5, the locking device applicable to the embodiments of the present disclosure will be described in detail.

Figure 4:
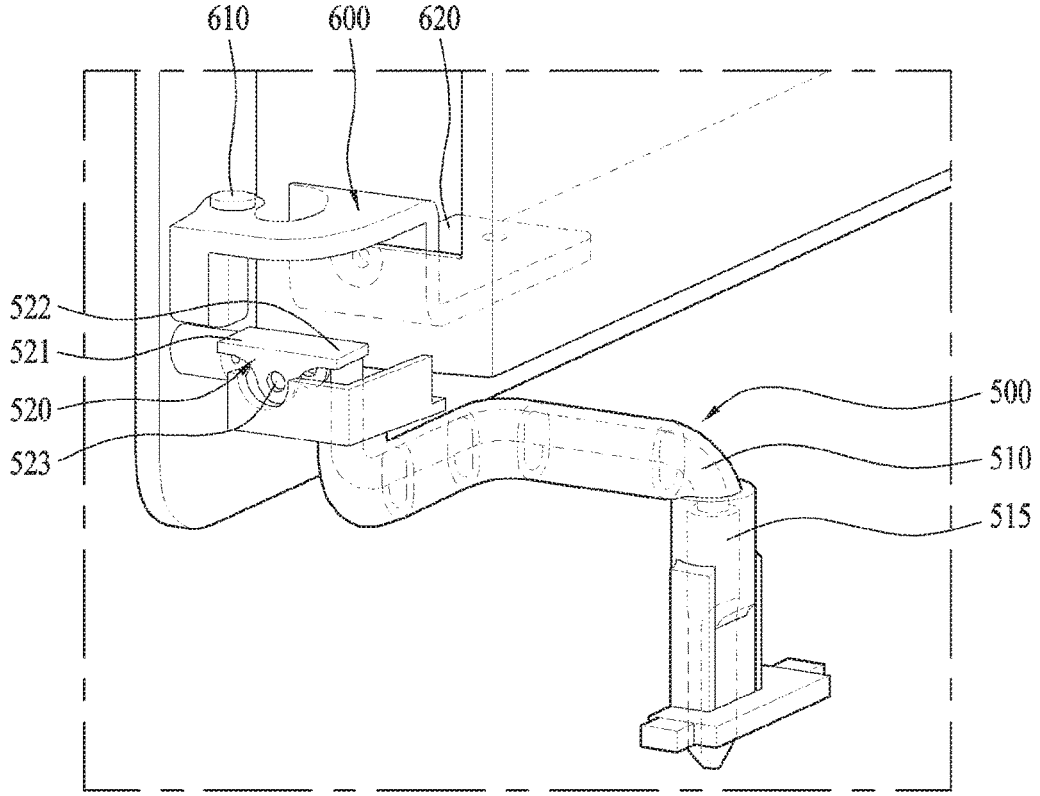
FIG. 4 is a diagram illustrating a locking device in a state the rotation of the second door with respect to the first door is unlocked in the refrigerator in accordance with one embodiment of the present disclosure.
Figure 5:
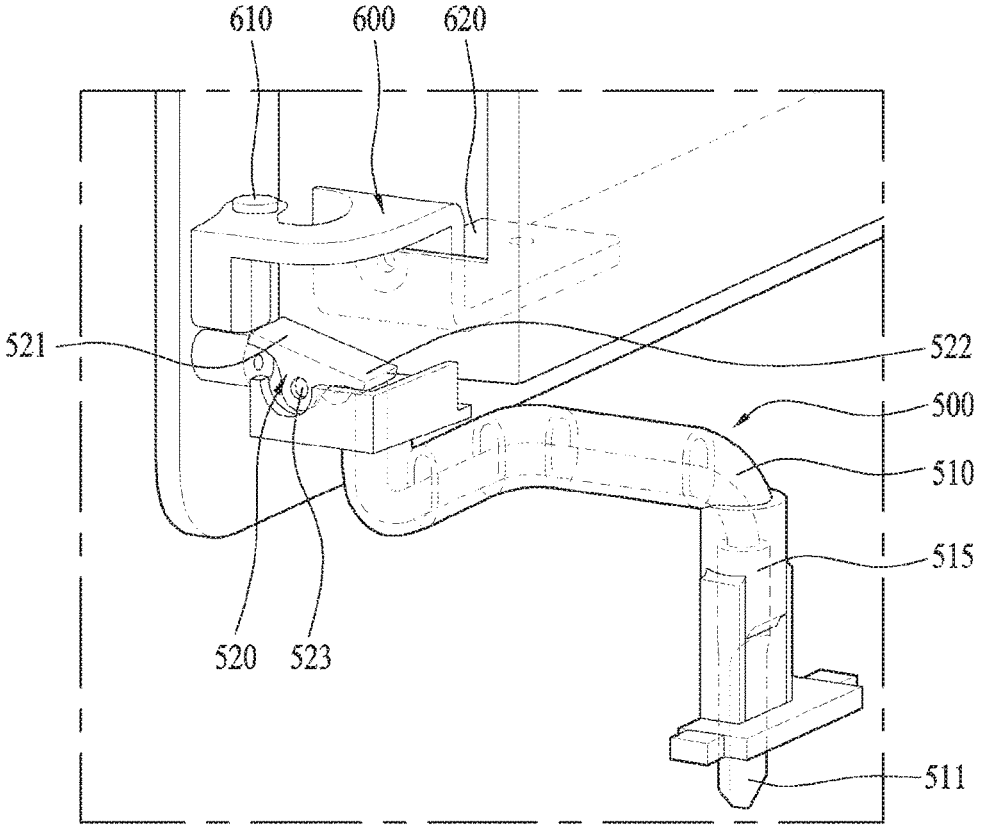
FIG. 5 is a diagram illustrating the locking device in a state the rotation of the second door with respect to the first door is locked in the refrigerator in accordance with one embodiment of the present disclosure.

FIGS. 4 and 5 are diagrams to describe the structure and mechanism of the locking device. FIG. 4 shows that the rotation of the second door is allowed by the locking device and FIG. 5 shows that the rotation of the second door is restricted by the locking device.

The locking device 500 may include a hooking member 521. A stopper 630 may be further provided to be selectively locked by the hooking member 521. When the stopper 630 is restricted by the hooking member 521, the second door 400 is not allowed to rotate with respect to the first door 300.

Specifically, the stopper 630 may be provided in the second door 400 and then integrally rotated together with the second door 400. The locking of the stopper rotation means the locking of the second door rotation and the allowance of the stopper rotation means the allowance of the second door rotation.

The stopper 630 may be formed in a hinge 600 for rotating the second door 400 with respect to the first door 300. To be distinguished from a hinge of the first 300, the hinge 600 may be referred to as a second hinge or sub-hinge.

The hinge 600 may include a hinge shaft 610 and a hinge bracket 620 coupled to the second door 400 so that the second door 400 can be rotatable on the hinge 610 with respect to the first door 300.

The stopper 630 may be provided in the hinge 600 and integrally formed with the hinge.

The stopper 600 has the hinge shaft 610 and a predetermined radius. Accordingly, when the second door 400 is rotated with respect to the first door 300, the stopper 600 is also rotated on the hinge shaft 610.

The hinge shaft 610 and the stopper 600 may be provided in the first door 300. In other words, the hinge shaft 610 and the stopper 600 may be located in the first door 300 via a hinge opening 330 formed in the door frame 305 of the first door 300. The hinge bracket 620 is coupled to the second door 400 from the outside of the first door 300. The hinge shaft 610 is rotatably coupled to the first door 300 from the inside of the first door 300. Of course, a predetermined space in which the stopper 600 is able to rotate, in other words, a hinge accommodating portion may be formed in the first door 300.

As shown in FIG. 4, the position where the hooking member 521 does not locks the stopper 630 may be a first position. When the hooking member 521 is arranged in the first position, the second door 400 is able to be rotated with respect to the first door 300 freely. At this time, the first door is closed.

As shown in FIG. 5, the position where the hooking member 521 locks the stopper 630 may be a second position. When the hooking member 521 is arranged in the second position, the rotation of the second door 400 with respect to the first door 300 is locked. At this time, the first door 300 is open.

The locking device 500 selectively locks the stopper 600 by moving the hooking member 521 from the first position to the second position or vice versa. The displacement or moving position of the hooking member 521 has to be varied according to an opening/closing state of the first door 300. In other words, the hooking member 521 is able to move in connection with the opening/closing of the first door 300.

For that, the locking device 500 may include a moving member 510 having different displacements according to the opening/closing state of the door. The displacement of the moving member 510 is directly variable according to the opening/closing state of the door.

The moving member 510 may be located in the first position in a state where the first door is closed and the second position in a state where the first door 300 is open.

When the moving member 510 is located in the first position in a state where the first door 300 is closed, the hooking member 521 is also located in the first position. At this time, the second door 400 may be rotated with respect to the first door 300. When the moving member 510 is located in the second position in a state where the first door 300 is open, the hooking member 521 is also located in the second position. At this time, the second door 400 is locked not to be rotated with respect to the first door 300.

Meanwhile, the displacement direction of the moving member may be different from the displacement direction of the hooking member. The position where the moving member is directly affected by the opening/closing state of the first door 300 may be different from the position of the hooking member.

In the illustrated embodiment, the first position is the place where the hooking member 521 is moved downward and where the moving member 510 is moved upward. The second position is the place where the hooking member 521 is moved upward and the moving member is moved downward. Accordingly, the displacement direction of the hooking member 521 is different from the displacement direction of the moving member 510 and specifically, they may be opposite to each other.

In the illustrated embodiment, a switchover member 520 may be further provided to switch the displacement of the moving member 510 into the displacement of the hooking member 521. For example, the switchover member 520 may covert the downward displacement of the moving member 510 into the upward displacement of the hooking member 521 and the upward displacement of the moving member 510 into the downward displacement of the hooking member 521.

The switchover member 520 may be formed in a seesaw-like shape and include a central shaft 523. The central shaft 523 includes first and second extended portions extended to both sides.

The first extended portion 522 may be interworking with the moving member 510. The upward and downward movement of the moving member 510 may be transferred to the upward and downward movement of the first extended portion 522.

Specifically, when the moving member 510 is moved upward or lifted, the first extended portion 522 is pushed up by the moving member 510 and ascends. In contrast, when the moving member 510 is moved downward, the first extended portion 522 is pulled down by the moving member 510 and descends.

The locking device may further include a flexible member. The flexible member may be provided in the central shaft 523. When the first extended portion 522 is moved upward, the flexible member may be deformed elastically. When the force applied to lift the first extended portion 522 is removed, that is, the moving member 510 is moved downward, the first extended portion 522 may be moved downward by the elastic restoring force of the flexible member.

In case the switchover 520 has the seesaw-like shape, the upward movement of the second extended portion 521 is opposite to the upward movement of the first extended portion 522. Accordingly, the first extended portion 522 may serve as the hooking member 521.

As mentioned above, most elements of the locking device 500 may be located in the first door and a predetermined portion of the moving member 510 is movable within the first door 300. The moving member 510 has to interwork with the opening/closing state of the first door 300 and generate the displacement of the hooking member 5210. Accordingly, both ends of the moving member 510 may be arranged in different up-and-down and right-and-left positions.

In this instance, it is preferred that the moving member 510 has one or more bending portions. One or more bending portions may be formed in the moving member 510 to compensate deviation in positions of the main-hinge and the hinge 600. The bending portions may include a vertical bending-portion and a horizontal bending-portion. As shown in FIGS. 4 and 5, two vertical bending portions and one horizontal bending portion are formed in the moving member 510.

The moving member 510 has to moveable within the first door 300 smoothly. The locking device 500 may include a housing 515 accommodating a predetermined portion of the moving member 510 and guiding the displacement of the movable member 510. The housing 515 may be also provided in the first door 300. Even when the internal space is filled with a foaming agent, the foaming agent is filled in only an external space of the housing 515 in the first door 300. Accordingly, the moving member 510 can be moved in the housing 515.

As described above referring to FIGS. 4 and 5, the moving member 510 of the locking device 500 is related to the opening/closing of the first door 300. Hereinafter, referring to FIG. 6, the mechanism for relating the moving member 510 with the opening/closing of the first door 300 will be described.

Figure 6:
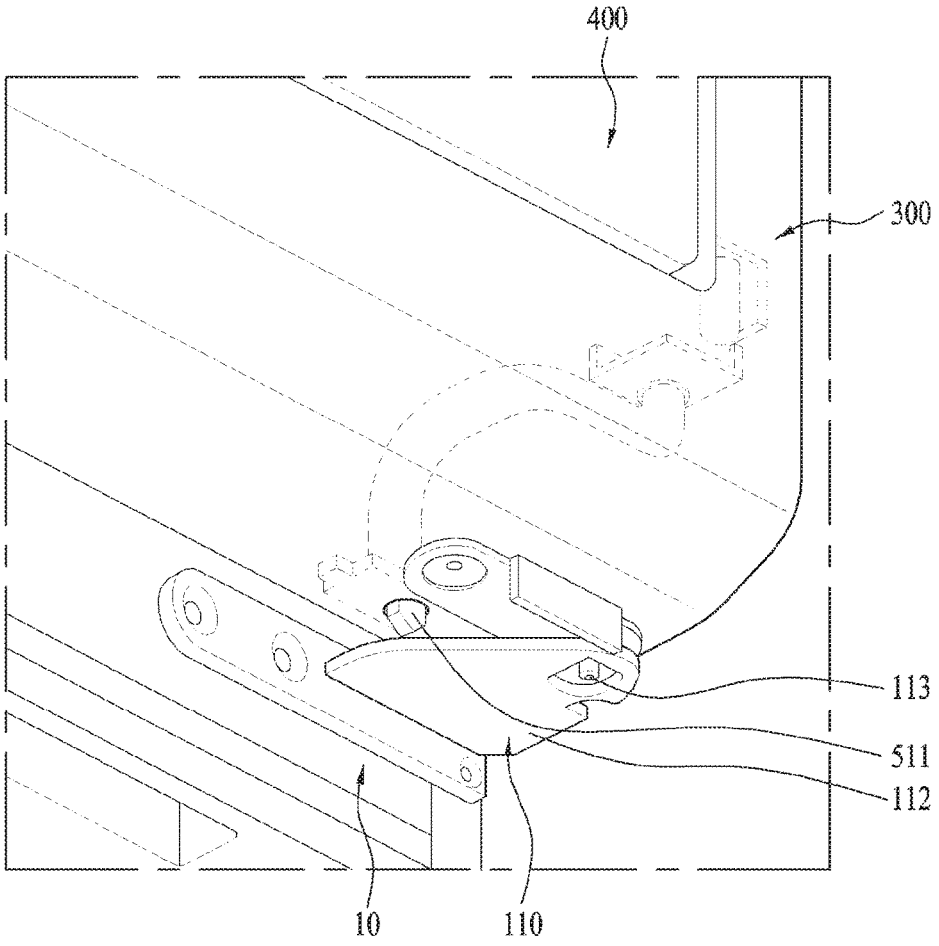
FIG. 6 is a diagram illustrating that the locking device of the refrigerator is connected with opening of the first door.

FIG. 6 illustrates that the first door 300 is rotatably connected to the cabinet 10 via the main-hinge 110. It is shown that the first door 300 is closed.

In a state where the first door 300 is closed, the moving member 510 is located in the first position. For example, the first position may be an upwardly-moved position and the moving member 510 is able to keep contact with a reference member 112 provided in the cabinet 10. In other words, the moving member 510 becomes in contact with the reference member 112 and becomes located in the first position, in a state where the first door 300 is closed.

Hence, the first door 300 is open and the moving member 510 is located in the second position. For example, the second position may be a downwardly-moved position. The moving member 510 may be moved to be located not in contact with the reference member 112 provided in the cabinet 10. In other words, the moving member 510 may be moved to release the contact with the reference member 112 and then located in the second position, in a state where the first door 300 is open.

The reference member 112 may be configured to be coupled to the cabinet 10 and it is fixed to the cabinet, regardless of the rotation of the first and second doors 300 and 400. Accordingly, the first door may be rotatable with respect to the cabinet 10, more specifically, the reference member 112.

The state where an angle between the first door 300 and the shaft 113 is zero degree is the state where the first door 300 is closed. The moving member 510 is also rotated on the shaft 113 at the same angle as the angle at which the first door 300 is open.

When the first door 300 is slightly open in the position shown in FIG. 6, one end 511 of the moving member 510 is also rotated and the contact between the moving member 510 and the reference member 112 is then released, so that the moving member 510 can be moved downward. Such the downward movement of the moving member 510 means the locking or restricting of the second door rotation as mentioned above.

In contrast, when first door 300 is closed, the moving member 510 contacts with the reference member 112 and moves upward. In other words, the moving member 510 may rise along the reference member 112.

The moving member 510 may be configured to ascend or descend along the reference member 112. To facilitate the making or releasing of the contact between the moving member 510 and the reference member 112, inclined portions may be formed in both sides of the end 511 of the moving member 510, respectively.

Meanwhile, the reference member 112 may be extended from the cabinet 10, more specifically, formed in the main-hinge 110.

The main-hinge 110 may include a main-hinge bracket 111 coupling the main-hinge 110 to the cabinet; and a horizontal bracket 112 supporting vertical load of the main-door. The horizontal bracket 112 may be provided in a lower portion of the first door 300 and support the upper vertical direction force or a lower vertical-direction force applied to the main-door.

The main-hinge shaft may be formed via the horizontal bracket 112. The horizontal bracket 112 may be configured to connect the main-hinge bracket with the main-hinge shaft. In the illustrated example, the reference member 112 may be the horizontal bracket 112.

FIG. 6 illustrates the lower main-hinge provided in a lower portion of the first door 300 and the moving member 510 in relation the lower main-hinge. However, the moving member 510 may be related to the upper main-hinge. In this instance, the moving member 510 descends when the first door 300 is closed and ascends when the first door 400 is open.

The moving member 510 may penetrate a lower lateral wall of the first door 300. In other words, one end of the moving member 510 may be extended toward the reference member 112 via the lower lateral wall of the first door 300.

The opening/closing direction of the first door 300 is different from the moving direction of the moving member 510. Although the user applies a force to the first door 300 back and force, the moving member 510 may be moved up and down.

The flexible member mentioned above provides the elastic restoring force to vertically move the moving member 510. Accordingly, the direction of the elasticity generated by the flexible member and the direction of the elastic restoring force are unrelated to the opening/closing direction of the first door 300.

That is related to the sealing of the first door 300. The directions of the elastic force and elastic restoring force are unrelated to the sealing of the door. For example, the elastic restoring force is working in the reverse direction of the sealing force direction of the door. That is, the elastic restoring force acts in the direction in which the first door 300 is open. In this instance, the sealing of the door could be deteriorated only to increase needs for a door gasket having a stronger magnetic force.

However, the elastic restoring force is unrelated to the opening/closing direction or sealing direction of the door in the illustrated example, only to prevent the deterioration of the sealing force caused by the locking device 500.

The most elements of the stopper 630 and the locking device 600 are arranged in the first door 300. As mentioned above, the end 511 of the connection member is partially extended outside the first door 300.

The end 511 of the connection member is partially exposed to an upper surface or a lower surface of the first door 300 and then substantially invisible out of the user's sight, so that the user cannot recognize or notice the structure or working mechanism of the locking device 500. Accordingly, the refrigerator may be provided with a beautiful design.

Hereinafter, the mechanism of the locking device will be described.

As shown in FIGS. 4 and 5, the moving member 510 and the hooking member 521 are located in the first position and then the movement of the stopper 630 is not locked or restricted by the hooking member 521. In other words, the second door 400 is able to be freely rotated with respect to the first door 300 in a state where the first door 300 is closed.

The first position is the position where the moving member 510 is moved upward and the hooking member 521 is moved downward. The stopper 630 located in the first position may freely move over the hooking member 521.

As shown in FIGS. 5 and 6, the moving member 510 and the hooking member 521 are located in the second position and the movement of the stopper 630 is then locked or restricted by the hooking member 521. In a state where the first door 300 is open, the second door 400 is unable to be rotated with respect to the first door 300.

Specifically, the second position is the location where the moving member 510 is moved downward and the hooking member 521 is moved upward. The stopper 630 located in the second position is not able to be rotated further by the hooking member 521. Accordingly, the rotation of the second door 400 is restricted by the rotation of the stopper 630.

As mentioned above, the locking device 500 is functioned to prevent the second door 400 from getting open with respect to the first door 300 in a state where the first door 300 is open. Accordingly, the user is able to open the second door 400 smoothly in a state where the first door 300 is closed. However, the locking device 500 is configured not to lock the opening of the first door 300 in a state where the second door 400 is open. In other words, the user is able to re-open the first door 300 in a state where only the second door 400 is open. In this instance, there is no problem when the user closes the second door 400 after closing the first door 300. However, it is likely for the user to close the second door 400 in a state of not closing the first door. At this time, the first door 300 is kept open and the hooking member 521 is located in the second position as shown in FIG. 5. Accordingly, the second door 400 happens to run into the hooking member 521 when the second door 400 is closed in that state.

Figure 7:
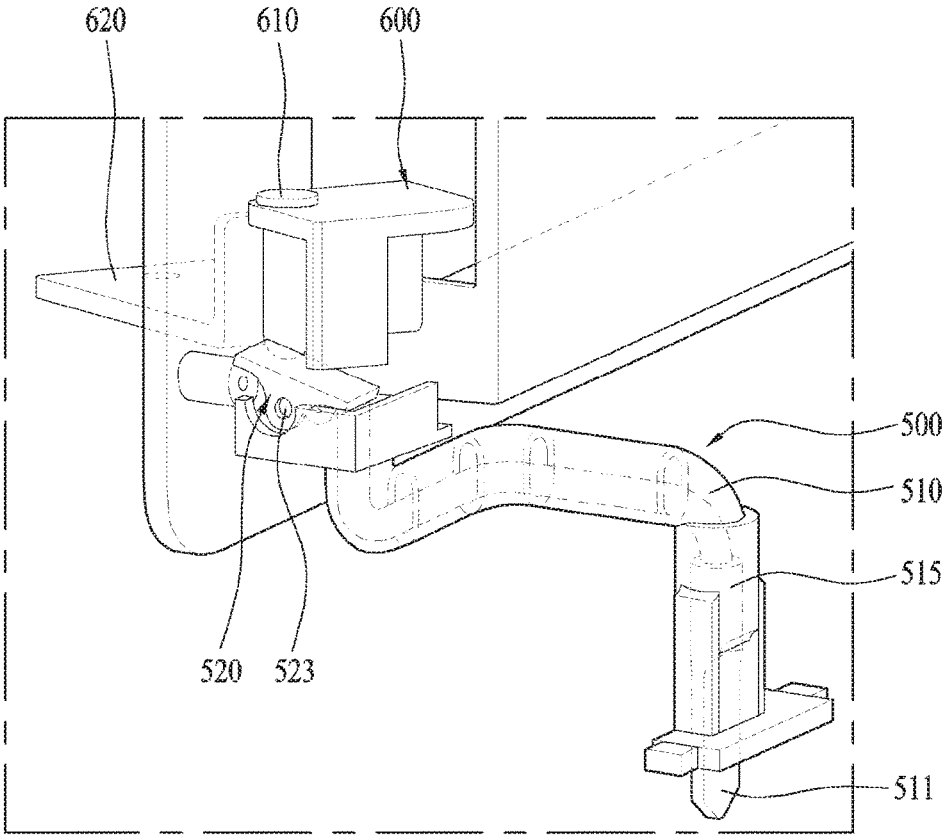
FIG. 7 is a diagram illustrating the locking device in a state where the first door and the second door are open in the refrigerator in accordance with one embodiment of the present disclosure.

The switchover member 520 may be functioned to solve the problem of the collision. FIG. 7 illustrates that both of the first and second doors 300 and 400 are open.

As shown in FIG. 7, the state where the first and second doors 300 and 400 are open may mean the state where the stopper 630 is rotated in a counter-clockwise direction with respect to the hinge shaft 610, which is the state where the stopper 630 is located on the right to the switchover member 520. The first door 300 is open basically and it means that the hooking member 521 is moved upward.

When only the second door 400 is closed after both of the first and second doors 300 and 400 are open, the second door 400 may be rotated in a clockwise direction. At this time, the stopper 630 may be moved upward along the switchover member 520 to the left portion of the switchover member 520 and the stopper 630 then moves the hooking member 521 downward. If the stopper 630 is moved too far over the hooking member 521, the hooking member 521 is moved upward by the elastic restoring force of the flexible member. It means that the hooking member 521 restitutes into the initial shape when the second door 400 is closed completely.

An upper surface of the switchover member 520 may be formed in a flat shape to allow the stopper 630 to be moved there over. It is preferred that the stopper 630 is sliding along the upper surface of the switchover member 520 smoothly. The stopper 630 is horizontally movable and the upper surface of the switchover member 520 is inclined with respect to the stopper. That is because the switchover member 520 has one side the hooking member 521 is moved over and the other side formed in a downwardly-moved seesaw-like shape.

While the stopper 520 makes contact with the switchover member, the hooking member 521 is moved downward by the elastic deformation of the flexible member smoothly and then moved to its initial position.

The switchover member 520 switches the displacement of the moving member 510 into the displacement of the hooking member 521. Together with that, it is possible to flexibly deal with the user's abnormal opening order of the first and second doors 300 and 400.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet with a storage compartment;

a first door rotatably coupled to the cabinet, and that is configured to open and close the storage compartment;

a second door rotatably coupled to the first door;

a hinge that is configured to rotate the second door with respect to the first door, the hinge comprising a hinge shaft that forms a rotation axis of the second door, a hinge bracket coupled to the second door;

a stopper that is configured to integrally rotate with the second door;

a locking device that is configured to selectively allow the rotation of the second door with respect to the first door, wherein the locking device comprises:

a moving member having different displacements according to an opening/closing state of the first door; and a hooking member having different displacements according to the displacements of the moving member and that is configured to selectively hook the stopper to the hooking member, and wherein the rotation axis of the second door extends in a first direction, wherein while the first door is opened or closed, the moving member moves in the first direction.

2. The refrigerator of claim 1, wherein the stopper is hooked to the hooking member to lock the rotation of the second door with respect to the first door.

3. The refrigerator of claim 1, wherein the hinge shaft, the hinge bracket, and the stopper being integrally formed with each other.

4. The refrigerator of claim 3, wherein the stopper is provided in a predetermined portion having a preset radius from the hinge shaft, and the stopper is rotated together with the second door, when the second door is rotated.

5. The refrigerator of claim 3, wherein a hinge accommodating portion is provided inside the first door and accommodates the hinge shaft and the stopper, and the stopper is rotatable within the hinge accommodating portion.

6. The refrigerator of claim 1, wherein the moving member is located in a first position in a state where the first door is closed and in a second position when the first door is open.

7. The refrigerator of claim 6, further comprising:

a main-hinge configured to rotate the first door with respect to the cabinet, wherein the locking device is provided in the first door and integrally rotated with the first door.

8. The refrigerator of claim 7, wherein the main-hinge comprises:

a main-hinge bracket that is configured to couple the main-hinge to the cabinet; and a horizontal bracket supporting vertical load of the first door.

9. The refrigerator of claim 8, wherein:

the moving member is configured to make contact with the horizontal bracket and is located in the first position, in a state in which the first door is closed, and the moving member is configured to release the contact with the horizontal bracket and is moved downward to be located in the second position, in a state in which the first door is open.

10. The refrigerator of claim 9, wherein the moving member has a preset radius from a rotation axis of the first door, and is integrally rotated with the first door with respect to the rotation axis, in a state in which the first door is rotated.

11. The refrigerator of claim 9, wherein the moving member is configured to extend toward the horizontal bracket provided outside the first door from an internal space of the first door.

12. The refrigerator of claim 9, wherein the moving member comprises one end having inclined portions formed in both sides to facilitate relative movement of the moving member with respect to the horizontal bracket.

13. The refrigerator of claim 8, wherein the moving member comprises a plurality of bending portions to compensate a deviation in up, down, right and left locations between the main-hinge and the hinge.

14. The refrigerator of claim 6, wherein when the moving member is located in the first position, the hooking member is located in a unlocking position for unlocking the stopper, and when the moving member is located in the second position, the hooking member is located in a locking position for locking the stopper.

15. The refrigerator of claim 14, wherein when the moving member is moved upward to be located in the first position, the hooking member is moved downward to be located in the unlocking position, and when the moving member is moved downward to be located in the second position, the hooking member is moved downward to be located in the locking position.

16. The refrigerator of claim 15, further comprising:

a switchover member that is configured to switch an upward movement of the moving member into a downward movement of the hooking member, and switch a downward movement of the moving member into an upward movement of the hooking member.

17. The refrigerator of claim 16, wherein the switchover member comprises:

a central shaft;

a first extended portion that is configured to extend to one side from the central shaft and move upward in relation to the upward movement of the moving member; and a second extended portion that is configured to extend to the other side from the central shaft and move upward in the reverse direction of the first extended portion, the hooking member being formed by the second extended portion.

18. The refrigerator of claim 15, further comprising:

a flexible member that is configured to elastically deform when the hooking member is moved upward and provide an elastic restoring force when the hooking member is moved downward.

19. A refrigerator comprising:

a cabinet with a storage compartment;

a first door rotatably coupled to the cabinet, and that is configured to open and close the storage compartment;

a second door rotatably coupled to the first door via a sub-hinge;

a stopper that is configured to integrally rotate with the second door; and a locking device configured to selectively allow the rotation of the second door with respect to the first door, wherein the locking device comprises:

a moving member moved to be located in a first position in a state where the first door is closed and to be located in a second position when the first door is open;

a hooking member located in a locking position and a unlocking position, in relation to a movement of the moving member, and that is configured to selectively lock the stopper; and wherein the moving member is located in a first position in a state where the first door is closed and in a second position when the first door is opened, wherein while the first door is opened, the moving member moves from the first position to the second position, wherein a height of the first position is different from that of the second position.

20. The refrigerator of claim 19, wherein the height of the first position is greater than that of the second position.

* * * * *